United States Patent [19]

Perrier de la Bathie et al.

[11] Patent Number: 5,055,142

[45] Date of Patent: Oct. 8, 1991

[54] PROCESS FOR PREPARING PERMANENT MAGNETS BY DIVISION OF CRYSTALS

[75] Inventors: René Perrier de la Bathie, Saint Pierre d'Albigny; Joël Chavanne, Grenoble, both of France

[73] Assignee: Centre National de la Recherche Scientifique, France

[21] Appl. No.: 143,616

[22] PCT Filed: May 21, 1987

[86] PCT No.: PCT/FR87/00175

§ 371 Date: Dec. 26, 1990

§ 102(e) Date: Dec. 26, 1990

[87] PCT Pub. No.: WO87/07425

PCT Pub. Date: Dec. 3, 1987

[51] Int. Cl.[5] ..... H01F 41/02

[52] U.S. Cl. ..... 148/101; 148/120

[58] Field of Search ..... 148/101, 102, 120

[56] References Cited

FOREIGN PATENT DOCUMENTS 0133758 3/1985 European Pat. Off. .
0162549 11/1985 European Pat. Off. .
0231620 8/1987 European Pat. Off. .
2258239 1/1975 France .

OTHER PUBLICATIONS

Givord, D. et al., "Magnetic Properties and Crystal Structure of $Nd_2Fe_{14}B$", *Solid State Communications*, vol. 50, No. 6, 1984.

Journal of Applied Physics, vol. 59, No. 4, Feb. 15, 1986.

*Primary Examiner*—R. Dean
*Assistant Examiner*—George Wyszomierski
*Attorney, Agent, or Firm*—Wall and Roehrig

[57] ABSTRACT

Method for the preparation of permanent magnets at room temperature from an alloy containing at least a mixture of iron (Fe), boron (B) and rare earths (RE) including Yttrium, and for which there is a temperature range wherein said alloy is in two phases; one solid and brittle and the other one liquid. The method comprises heating said alloy under controlled atmosphere at a temperature sufficient to reach said temperature range, treating said alloy, and finally, optionally, allowing the treated alloy to cool. The method being characterized on the one hand in that said Fe-B-Re alloy is in a massive form, and on the other hand, in that the treatment of said massive alloy is carried out by welding of the magnetic solid phase Fe-B-Re.

4 Claims, 1 Drawing Sheet

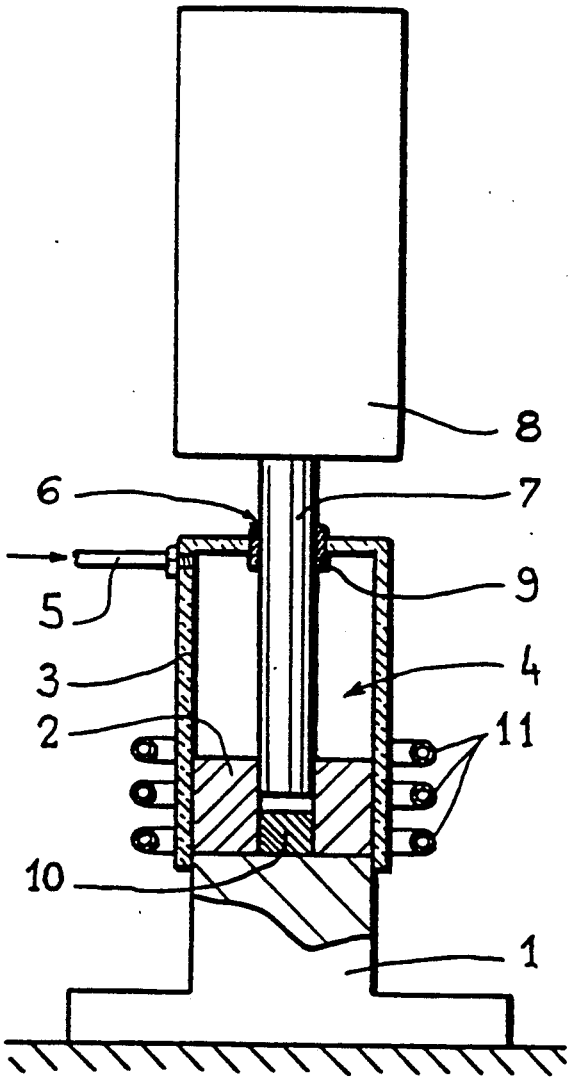
8
6
7
9
5
3
4
2
11
10
1

PROCESS FOR PREPARING PERMANENT MAGNETS BY DIVISION OF CRYSTALS

The invention relates to a new process for making high-performance permanent magnets by division of the crystals of a magnetic phase in an alloy In the manufacture of permanent magnets, it was well known to employ metal alloys of iron (Fe)-Boron (B) also including Rare Earths (RE). At the present time, there are essentially two types of preocess for manufacturing such magnets.

In the first process employing powder metallurgy, described in European Patent Applications EP-A-0 101 552, 0 106 948 and 0 126 802, an iron-boron-rare earth alloy is made which is ground in the form of powder, then oriented in a magnetic field which is compressed cold, which is sintered and finally which is subjected to a heat treatment. Although the magnets obtained in this way present excellent properties, this process nonetheless presents noteworthy drawbacks. In fact, the slightest pollution considerably alters the final properties. Now, pollution of the powder by the atmosphere is extremely rapid; this therefore necessitates working under a controlled atmosphere at ambient temperature, which increases manufacturing costs. In addition, it is necessary to employ a grinding phase. Now, the powders used present a high reactivity, particularly with respect to air, which unfortunately involves considerable risks of explosion and of fire.

The second process employs the technique of microcrystallization. This technique, described in European Patents EP-A-0 125 752 or EP-A-0 133 758, essentially consists in melting an alloy of the type in question, then in subjecting it to a treatment of rapid hardening on roller, in crushing and hot-pressing, or in coating the material obtained in a resin. This technique of very fine jet of liquid at high temperature hardened on cold roller unfortunately leads to isotropic magnets, unless they are subjected to an operation of creep and of recrystallization which is always difficult to carry out in a continuous process. In addition, as a high-temperature fusion is employed with ejection of a very fine liquid, an appropriate apparatus must be used and operation must be carried out in a controlled atmosphere in large-dimensioned enclosures with all the drawbacks that this comprises.

Finally, in these two techniques, one necessarily passes through a phase in the course of which the alloy is considerably divided.

The invention overcomes these drawbacks. It envisages a process of the type in question which is easy to carry out, employs conversions of more economical raw materials, and leads to materials having improved properties.

This process for preparing permanent magnets at ambient temperature from an alloy containing at least one mixture of Iron (Fe), Boron (B) and another element selected from the group that includes rare earth (RE) and yttrium (Y), and for which there is a temperature range inside which said alloy is in two phases: one solid and fragile, and the other liquid. In this process:

said alloy is heated in a controlled atmosphere at a sufficient temperature to attain the said temperature range;

then this alloy is treated;

and finally, the treated alloy is possibly left to cool.

The process is characterized:

on the other hand, in that said Fe/B/RE alloy is in bulk-state form;

and, on the other hand, in that treatment of this massive alloy is effected by welding the magnetic Fe/B/RE solid phase.

In other words, the invention consists firstly in no longer employing an alloy in the form of powder but a bulk alloy comprising two phases, then in heating this bulk alloy, and finally in subjecting it to high mechanical stresses to induce a welding at a temperature allowing the fracture of the magnetic crystals into particles dimensioned on the order of tens of microns and finally, favorably, in cooling this alloy.

In the following specification and claims, the term "controlled atmosphere" is used to designate an atmosphere of which the composition is monitored; in practice, it is question of an atmosphere of noble gases or vacuum, and that in order to avoid reactgions with the Rare Earths;

The term "welding" designates a mechanical treatment applied to the binary-phase (part liquid/part solid) metallic alloy, intended to provoke grain refining of this alloy; treatments of forging, hammering, rolling, extrusion, vibroramming (ramming by vibrations), may be mentioned.

Advantageously, in practice:

the bulk-state alloy is a ternary alloy based on Iron, Boron and Rare Earths, the group of rare earths in this case also including yttrium;

in practice, particularly for substantial reasons of economy and of mechanical properties, the Rare Earth is selected from the group constituted by Neodymium and Praseodymium, which in that case is in a larger proportion;

the respective proportions of the different constituents of this alloy, which may also contain other agents for forming eutectics, such as Aluminium or Gallium, correspond to the usual proportions, particularly those described in the European Patent Applications mentioned in the preamble;

the alloy is in the form of bulk-state ingots, possibly in the form of massive pieces; in that way, in other words, during application of the mechanical stresses of welding, the magnetic crystals are broken hot in the liquid which surrounds them in final phase;

heating of the massive alloy can be effected by any known means, such as Joule effect or induction, the alloy being able to be either in a right envelope or in vacuo or in a noble gas;

the bulk alloy thus heated is welded either in vacuo or in a noble gas, or in a non-reactive liquid, or even in a tight envelope that may undergo the mechanical and thermal treatments, such as for example and envelope of mild Iron or an alloy based on Iron;

heating is effected at a temperature of between 400° and 1050° C., preferably in the vicinity of 700° C., in any case at a sufficient temperature to attain the plasticity of the non-magnetic eutectic phase; it has been observed that, if the temperature is lower than 400° C., the alloy is reduced to powder, this returning to the first technique set forth in the preamble, whilst, if this temperature exceeds 1050° C., the phenomenon of welding is no longer obtained, as the magnetic grains become too malleable and enlarge as the treatment continues;

the mechanical stresses of welding are developed as already stated, by forging, hammering, extrusion, rolling or any other thermo-mechanical treatment; it has been observed that the size of the magnetic crystals obtained results from the rate of welding applied in the products; it has thus been observed that good results are obtained with a deformation ratio higher than ten, advantageously of the order of twenty five;

after possible cooling, the treated alloy undergoes a treatment of annealing and/or of tempering at temperatures of between 600° and 1000° C. and even more, preferably between 700° and 900° C., which improves and stabilizes the magnetic properties, particularly the coercivity.

In other words, the fundamental characteristic of the invention consists in not employing an alloy in the form of powder but a bulk alloy, which is much more economical and less dangerous, then in treating this bulk alloy by welding, which no longer necessitates employing complex and expensive apparatus.

The manner in which the invention may be carried out and the advantages following therefrom will be more readily seen from the following embodiments given by way of non-limiting indication in support of the accompanying single Figure.

BRIEF DESCRIPTION OF THE DRAWING

The sole drawing Figure schematically shows an installation for carrying out the process according to the invention.

This installation basically comprises an anvil 1 on which rests a holding ring 2 surrounded by a glass enclosure 3, defining a tight chamber 4, connected by the inlet 5 to a source of Argon (not shown). The top of the tight chamber comprises an opening 6 through which the hammer 7 of the outside striking assembly 8 may pass through an O-ring 9. The sample 10 rests on the anvil 1 around the ring 2 in which the hammer slides. The glass enclosure 3 is surrounded by turns 11 for heating by induction.

EXAMPLE 1

In known manner, a massive sample (washer, moulded cylinder, case ingot, shot, . . . ) is prepared from an Iron/Boron/Rare Earth alloy, essentially comprising for one hundred atoms:

78 atoms of Iron;
6 atoms of Boron;
15.5 atoms of Neodymium;
0.5 atom of Aluminium.

Pieces of alloy of any shape are placed on the anvil 1, within the ring 2. Argon is injected at 5 and by induction (11), the plate 10 is heated to 650° C. for five minutes. When this temperature is attained, the plate 10 is hammered for two minutes by the assembly 7, 8, developing a power of six Joules per strike at a rate of one thousand eight hundred strikes per minute. A bulk-state plate of twenty millimetres diameter and five millimetres thickness is obtained.

It should be noted that, at that temperature, the fusible phase is a poorly identified mixture of metallic phases and even possibly of salts (fluorides and chlorides of Rare Earths) and of oxides. The principal magnetic phase tetragonal $Nd_2Fe_{14}B$ remains present up to at least 1050° C. and during all the mechanical treatments or annealing.

It is then left to cool for three minutes down to 70° C.

The plate thus obtained presents an intrinsic coercitive field of 300 kiloAmperes per metre (300kA/m), a density equal to 7.6 and a remanent induction of 0.55 Tesla.

The material obtained presents a quadratic, i.e. tetragonal crystalline structure $Nd_2Fe_{14}B$.

EXAMPLE 2

The same sample as in Example 1 is subjected to an additional operation of annealing for about thirty minutes at 800° C. carried out in chamber 4.

A magnet having an intrinsic coercitive field of 1000 kA/m, a remanent induction of 0.85 Tesla, an internal energy of 1000 kiloJoules per cubit metre and a density of 7.6, is thus obtained.

EXAMPLE 3

Example 2 is repeated, applying during the annealing treatment a constant, unidirectional pressure on the sample 10. Strongly anisotropic magnets are thus obtained.

In these three Examples 1 to 3, the hammering operation is undertaken only when the ancillary phases are sufficiently plastic in order to induce only refining of the crystals responsible for the magnetic properties.

EXAMPLES 4

Three kilos of a bulk NdFeB alloy, of atomic composition: $Nd_{15.5}Fe_{78}B_6Al_{0.5}$, are made. This bulk alloy is cast into a mild Iron recipient having a diameter of sixty millimetres, a length of two hundred millimetres and a thickness of six millimetres.

After coolilng, the recipient is hermetically closed.

After heating the massive alloy in its container to 750° C., the whole is extruded in an extruder of appropriate shape, for example in flat form. A rectangular bar of twenty five by seven millimetres and several metres long is then obtained, with a deformation ratio of 25 and an applied pressure of 13 kBar.

The magnet obtained is then cut to the desired length.

This magnet presents the following characteristics:

coercitive field $H_{Ci}$ : 700 kA/m,
coercitive induction field $H_{CB}$ : 400 kA/m,
remanent induction Br : 0.75 Tesla
internal engergy $BH_{max}$ : 100 kJ/m$^3$ these measurements being made in directions perpendicular to the direction of extrusion.

An operation of annealing is then carried out in a controlled atmosphere of rare gas.

The following characteristics are then obtained:

$H_{Ci}$: 1000 kA/m
$H_{CB}$: 480 kA/m
Br: 0.85 Tesla
BH: 120 kJ/m$^3$

In brief, it has been observed that the refining of the crystals of the alloy notably increases the coercivity of the whole. Moreover, as industry most often demands anisotropic permanent magnets, anisotropy is obtained as has already been stated by the application of a strong unidirectional pressure on the material treated, the eutectic phase being in plastic phase.

It has been observed that the stress applied to the bulk material increases the magnetic anisotropy in the direction of application. However, the amplitude of this phenomenon depends closely on the crystallographic orientation of the magnetic crystals before treatment: forging, extrusion, etc . . . .

In the case of any orientation whatsoever of the magnetic crystals before treatement, slightly anisoitropic magnets, of direction of difficult magnetization parallel to the axis of extrusion, and isotropic in the other two directions, are obtained.

Furthermore, the direction of growth of the crystals is perpendicular to the direction of easy magnetization.

It is therefore necessary to control the direction of growth of the magnetic crystals during the phase of solidification of the massive alloy. In fact, a unidirectional growth of crystals makes it possible to distribute the directions of easy magnetization in a plane perpendicular to the direction of growth, but not in a definite direction.

In this way, but judiciously selecting the direction of the stress during welding with respect to the orientation of the crystals, it is then possible to obtain completely isotropic magnets.

EXAMPLE 5

Three kilos of bulk-state alloy NdFeB are cast into a laterally cooled ingot mould. A basaltic crystallization perpendicular to the cold wall is thus obtained. The whole is then extruded in a metallic envelope by isostatic extrusion in the form of a flat rectangular bar of 25×7 mm section.

The ingot is placed so that the plane containing the directions of wasy magnetization is perpendicular to the rectangular bar and parallel to the axis of extrusion. Anisotropic magnets, oriented in the direction of the flat face, are thus obtained, having the following characteristics:

$H_{Ci}$: 1000 kA/m
Br: 1.0 Tesla
$H_{CB}$: 650 kA/m
$BH_{max}$: 200 kJ/m$^3$

The process according to the invention presents numerous advantages over the process set forth in the preamble, for example:

- the possibility of obtaining permanent magnets from the conversion of cheaper raw materials;
- easy and rapid to carry out, not employing any sophisticated equipment;
- the absence of quasi-absence of dangers for the environment, particularly risks of explosion or fire, since powders are not employed.

In summary, this process is characterized by a consequent reduction in costs and the elimination of the dangers in manufacturing the magnets of the Iron/Boron/-Rare Earth type, which are more and more sought after.

Consequently, this process may find numerous applications in the manufacture of permanent magnets, more particularly for manufacturing electric motors, general-purpose motors, electronic apparatus, loud-speakers.

We claim:

1. A process for preparing a magnet that is permanent at ambient temperatures, comprising the steps of selecting a bulk-state alloy having magnetic crystals, said alloy containing a mixture of a ferromagnetic transition element, boron, and at least one element chosen from the group consisting of the rare earth elements and yttrium;

heating and maintaing the bulk-state alloy in a controlled atmosphere to a temperature within a range of 400 degrees C. to 1050 degrees C. wherein the bulk-state allow is a two-phase mixture, one phase being solid and the other liquid;

mechanically welding the two-phase bulk-state alloy with a deformation ratio of at least ten, sufficient to fracture magnetic crystals of said solid phase into smaller particle sizes;

permitting the bulk-state alloy to cool; and annealing or tempering the bulk-state alloy at a temperature between about 600 degrees C. and 1000 degrees C.

2. The process according to claim 1 wherein the bulk state alloy is a ternary alloy containing iron boron and one or more rare earth elements and wherein a tetragonal magnetic phase, of said ternary alloy is present during the entire process.

3. The process according to claim 2 wherein the one or more rare earth element is selected from a group consisting of neodymium, praseodymium, and both neodymium and praseodymium.

4. The process according to claim 1, wherein the mechanical welding is effected by hammering, rolling, forging or extrusion in a tight envelop made of an iron-based alloy.

* * * * *